US007188966B1

(12) United States Patent
Lin

(10) Patent No.: US 7,188,966 B1
(45) Date of Patent: Mar. 13, 2007

(54) HAND TOOL WITH ILLUMINATOR

(76) Inventor: Hung Wen Lin, P.O. Box 36-80, Taichung City (TW)

( * ) Notice: Subject to any disclaimer, the term of this patent is extended or adjusted under 35 U.S.C. 154(b) by 0 days.

(21) Appl. No.: 11/444,209

(22) Filed: May 31, 2006

(30) Foreign Application Priority Data

Sep. 28, 2005 (TW) ..... 94216733 U

(51) Int. Cl.
*F21V 33/00* (2006.01)

(52) U.S. Cl. ..... 362/119; 362/120; 362/200

(58) Field of Classification Search ..... 362/119, 362/120, 109, 200, 205, 253
See application file for complete search history.

(56) References Cited

U.S. PATENT DOCUMENTS 6,238,058 B1 * 5/2001 Lin ..... 362/119
6,477,921 B1 * 11/2002 Picone ..... 81/170

* cited by examiner

*Primary Examiner*—Laura K. Tso
(74) *Attorney, Agent, or Firm*—Charles E. Baxley

(57) ABSTRACT

A hand toll equipped with an illuminator has a conductive assembly settled within the handle to provide power to a lamp assembly which can lighten the operating end of the hand tool. A user can push a switch back and forth to operate the conductive assembly and in turn switch on/off the illuminator.

9 Claims, 4 Drawing Sheets

HAND TOOL WITH ILLUMINATOR

BACKGROUND OF THE INVENTION

1. Field of the Invention

The present invention relates to hand tools and, more particularly, to an open end wrench equipped with an illuminator.

2. Description of Related Art

Operating a hand tool and an illuminator simultaneously would be an inconvenience to a worker who assembles and/or disassembles detachable components in a dark working environment by using a conventional wrench product. Generally, a worker holds a wrench in one hand and a light source in another hand. He may settle the light source properly and then work with both hands, however, once the working environments or angles vary, he may have to drop the tool to adjust the lighting. Such a repeated reciprocating action may cause waste of time as well as energy.

SUMMARY OF THE INVENTION

The present invention disclosed herein provides a hand tool equipped with an illuminator as a solution to foresaid inconvenience. As an illuminator is attached to a hand tool at the operating end thereof, the light source is capable of acting right around the operating area and facilitates operating the tool in dark.

To achieve these and other objects of the present invention, the hand tool equipped with a illuminator comprises:

a hand tool including a handle associated with an operating end;

a lamp bracket fixedly attached to said handle at a predetermined position and containing a accommodating space inside;

a pathway running through the handle to the operating end and a pinhole disposed on the side wall of the lamp bracket for connecting said pathway with the lamp bracket;

a conductive assembly disposed inside the accommodating space of said lamp bracket comprising a first conductive strip, a second strip and at least one battery connected to said first and second conductive strips at its anode and cathode respectively, wherein the first conductive strip and the at least one battery are immovably positioned in said accommodating space;

a lamp arranged within said pathway including a bulb and two terminal pins, wherein the bulb comes into close proximity with the operating end of the hand tool while the two terminal pins properly extend into said accommodating space of lamp bracket by way of said pathway and pinhole; wherein one of the terminal pins is adjacent and electrically connected to the first conductive strip and the other is adjoining the second conductive strip; and a cap for the lamp bracket fitting the opening of said accommodating space; a switch mounted on said cap; a fixing component disposed on the reverse side of the switch extending through the opening to attach to the second conductive strip of the conductive assembly; wherein the length of the opening may be greater than the length of the fixing component.

The technical measure taken by the invention to achieve foregoing purpose and effect is to provide controllable illumination at the operating end of a hand tool. When the lamp is switched on, the light source illuminates the working area and facilitates assembling operation in dark.

BRIEF DESCRIPTION OF THE DRAWINGS

The invention as well as a preferred mode of use, further objectives and advantages thereof, will best be understood by reference to the following detailed description of an illustrative embodiment when read in conjunction with the accompanying drawings, wherein:

FIG. 3 is a perspective view showing the lamp switched on;

DETAILED DESCRIPTION OF THE PREFERRED EMBODIMENT

Figure 1:
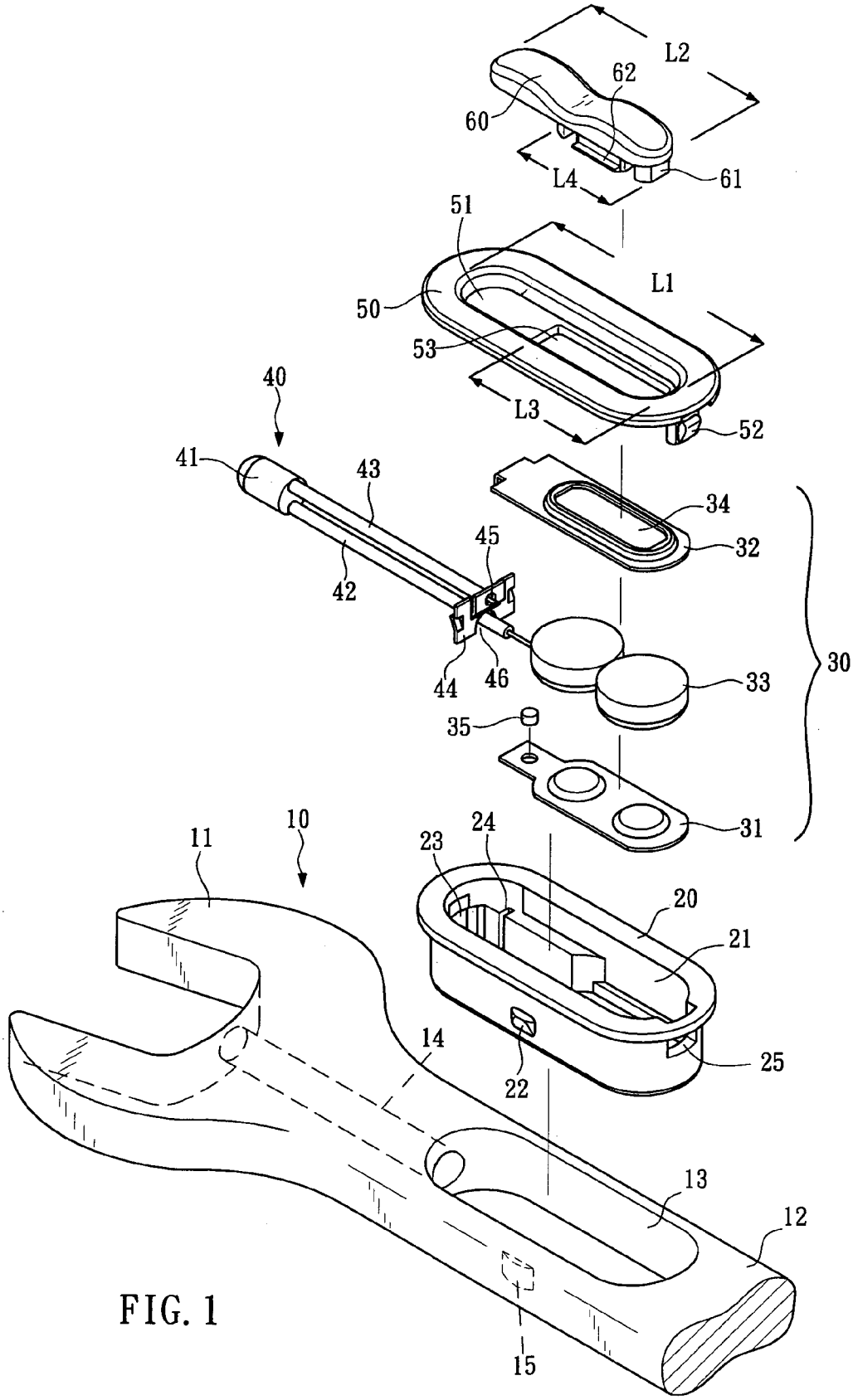
FIG. 1 is an exploded view of a hand tool with an illuminator according to the present invention.
Figure 2:
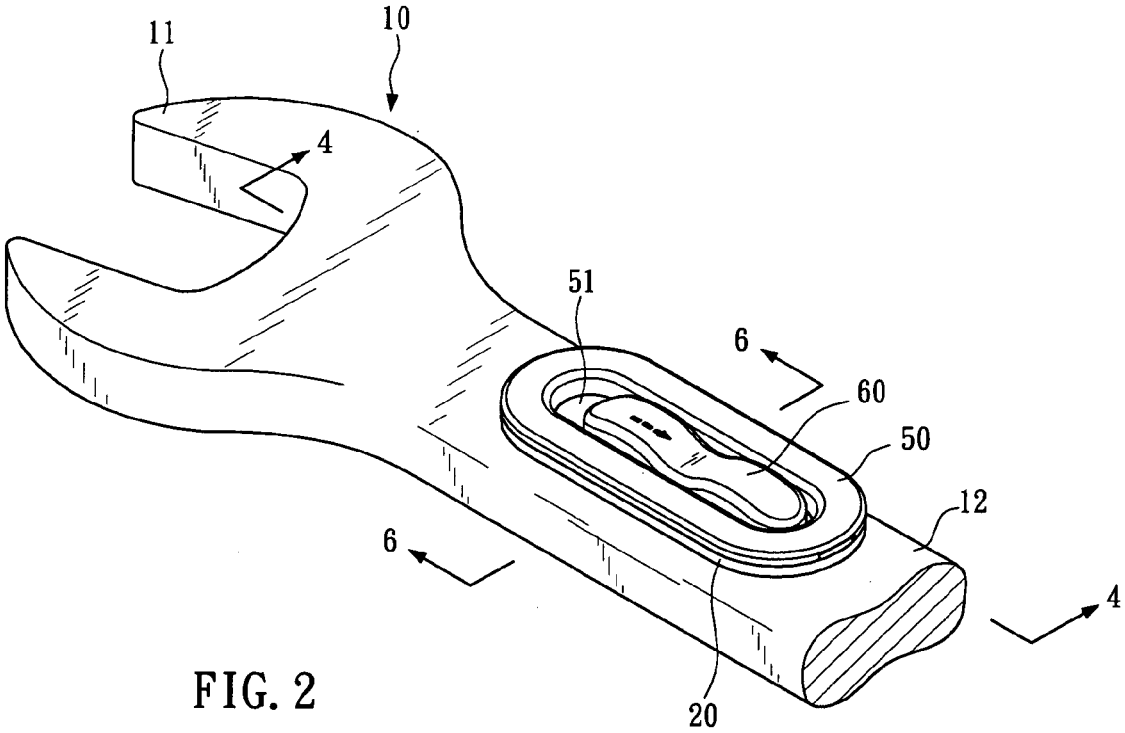
FIG. 2 is a perspective view showing the lamp switched off.

Referring to FIGS. 1 and 2, a hand tool equipped with an illuminator according to the present invention comprises following components;

A hand tool 10 includes a handle 12 associated with an operating end 11. In one embodiment of the present invention, the hand tool 10 is an open-end wrench.

An accommodating recess 13 is formed in the handle 12 and a pathway 14 is running through said recess 13 to the operating end 11.

A lamp bracket 20 stuffed into said accommodating recess 13 has an upward-opened accommodating space 21. The lamp bracket 20 and accommodating recess 13 each provides either a rabbet 15 or a tenon 22 for mutual coupling.

A conductive assembly 30 disposed inside the accommodating space 21 of said lamp bracket 20 comprises a first conductive strip 31, a second strip 32 and at least one battery 33 connected to said first and second conductive strips 31,32 at its anode and cathode respectively. Further, the first conductive strip 31 and the at least one battery 33 are immovably positioned in said accommodating space 21 while the second strip 32 is movably connected with the battery 33. Further, the second strip 32 is moveable along the longitudinal axis of the lamp bracket 20.

A lamp 40 which includes a bulb 41 and two terminal pins 42, 43 is fixed within the pathway 14 of said handle 12 and the bulb comes into close proximity with the operating end of the hand tool while the two terminal pins properly extend into said accommodating space 21 through said pathway 14 and the pinhole 23 on the wall of the lamp bracket 20. One of the terminal pin 42 is electrically connected with the first conductive strip 31 by way of a conductive component 35 and the other terminal pin 43 is associated with the second conductive strip 32.

A lamp base 44 received by a recess groove 24 on the wall of accommodating space 21 provides two through hole 45, 46 to hold and isolate the two terminal pins 42, 43.

A cap 50 has a depressed containing recess 51 which tightly fits the opening of said lamp bracket 20. Further, the cap 50 and lamp bracket 20 are fastened by means of a snap-lock device that comprises a female portion 25 on the lamp bracket 20 and a mating male portion 52 arranged on the cap 50.

A switch 60 mounted in and properly projects from said containing recess 51. The switch 60 further has a fixing component 61 on the bottom surface that connects with the second conductive strip 32 through an opening 53 at the bottom of the containing recess 51. Note that the length of the accommodating recess 51 (L1) is greater than the length of the switch 60 (L2) and the length of the opening 53 (L3) is greater than the length of the fixing component 61 (L4). Thereby, the switch 60 can move forth and back inside the containing recess 51 under a user's operation. Moreover, the second conductive strip 32 provides a fixing slot 34 matching the fixing component 61 and retaining a pair of wings 62 form at each side of the fixing component 61 by the bottom circumference thereof (as shown in FIG. 6).

Figure 3:
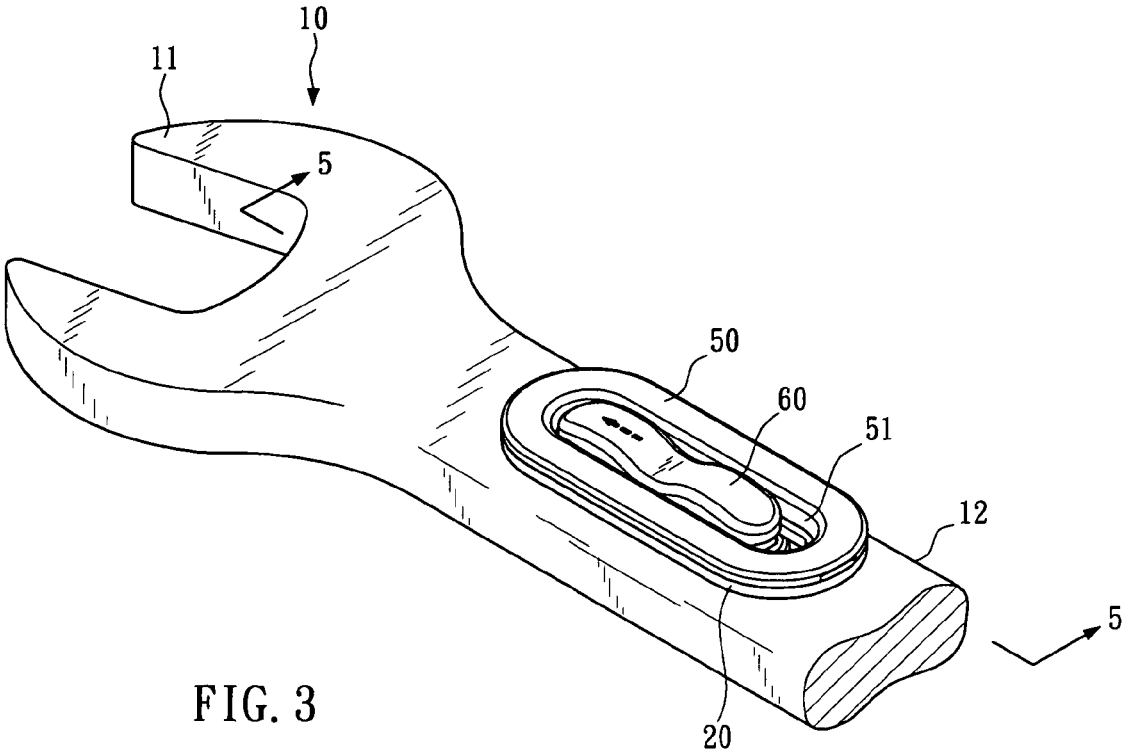
Figure 5:
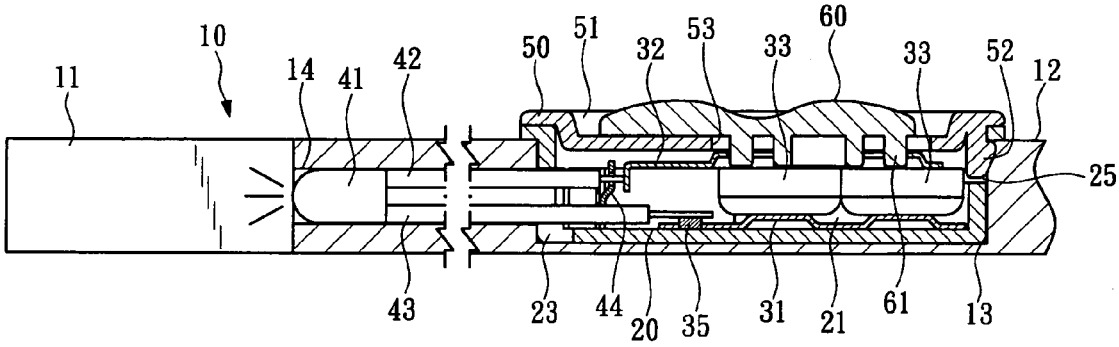
FIG. 5 is a sectional view taken along line 5—5 of FIG. 3.

As shown in FIGS. 3 and 5, when the switch 60 is pushed towards the operating end of the hand tool, it moves inside the containing recess 51 of the cap 50 and simultaneously the fixing component 61 drives the second conductive strip 32 to approach and contact the terminal pin 43 of the lamp 40. Whereupon, an electric circuit between the conductive assembly 30 and the lamp 40 is established to light up the bulb 41 of the lamp 40. As a result, the illuminator acts at the operating end 11 of the hand tool 10 to brighten the working area and therefore facilitates the operating end 11 of the hand tool 10 to accurately retain the components to be assembled and/or disassembled.

Figure 4:
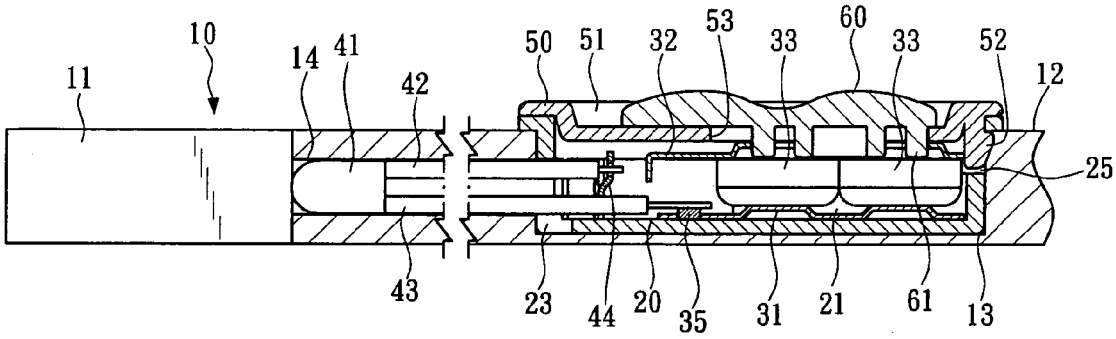
FIG. 4 is a sectional view taken along line 4—4 of FIG. 2.
Figure 6:
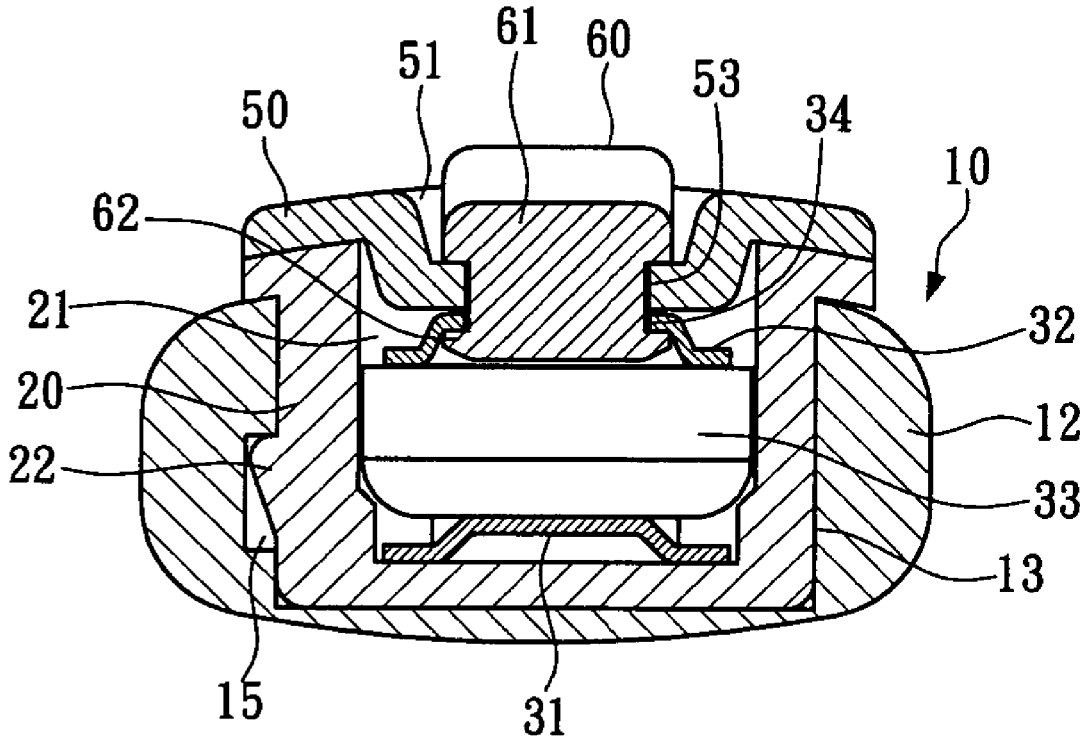
FIG. 6 is a sectional view taken along line 6—6 of FIG. 2.

Referring to FIGS. 4 and 6, when the switch 60 is pushed reversely, the fixing component 61 drives the second conductive strip 32 to leave and disconnect from the terminal pin 43 of the lamp 40. Whereupon, the power source to lamp 40 is therefore shut and the bulb 41 is switches off in turn.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A hand tool with an illuminator comprising:

a hand tool, including a handle associated with an operating end;

a lamp bracket fastened at a predetermined position on the handle having an accommodating space; a pathway running through the operating end from the handle and connected with a pinhole on the wall of the lamp bracket;

a conductive assembly disposed inside the accommodating space of said lamp bracket comprising a first conductive strip, a second strip and at least one battery connected to said first and second conductive strips at its anode and cathode respectively wherein the first conductive strip and the at least one battery are positioned immovably in said accommodating space;

a lamp which includes a bulb and two terminal pins fixed within the pathway wherein the bulb comes into close proximity with the operating end of the hand tool while the two terminal pins properly extend into said accommodating space through said pathway and the pinhole on the wall of the lamp bracket, wherein one of the terminal pin is electrically connected with the first conductive strip and the other terminal pin is associated with the second conductive strip;

a cap tightly fitting the opening of said lamp bracket; and a switch mounted in and properly projects from the cap having a fixing component on the bottom surface that connects with the second conductive strip through an opening at the bottom of the cap, wherein the length of the opening is greater than the length of the fixing component.

2. The hand tool with an illuminator as claimed in claim 1, wherein, the handle of the hand tool further comprises an accommodating recess for holding the lamp bracket tightly.

3. The hand tool with an illuminator as claimed in claim 2, wherein, the lamp bracket and the accommodating recess each has either a rabbet or a tenon on the opposite walls for mutual coupling.

4. The hand tool with an illuminator as claimed in claim 1, wherein, a lamp base fixed in the accommodating space of the lamp bracket provides two through hole to hold and isolate said two terminal pins.

5. The hand tool with an illuminator as claimed in claim 1, wherein, each of the bottom of the cap and the opposite wall of the bracket provides a female portion or a mating male portion to engage mutually.

6. The hand tool with an illuminator as claimed in claim 1, wherein, a depressed containing recess is disposed on the cap to receive the switch, wherein the length of the containing recess is greater than the length of the switch; wherein the switch is properly projective from the cap; wherein the peripheral wall of the containing recess closely matches the opening of the lamp bracket and the bottom of the containing recess has a opening for the fixing component passing through.

7. The hand tool with an illuminator as claimed in claim 1, wherein, the second conductive strip provides a fixing slot mating the fixing component.

8. The hand tool with an illuminator as claimed in claim 7, wherein, the fixing component further has a pair of wings to be retained by the bottom circumference of the fixing slot.

9. The hand tool with an illuminator as claimed in claim 1, wherein, the hand tool is an open-end wrench.

* * * * *